US007281772B1

(12) United States Patent
Atkinson

(10) Patent No.: US 7,281,772 B1
(45) **Date of Patent: *Oct. 16, 2007**

(54) OUTDOOR STORAGE COMPARTMENT

(76) Inventor: Richard Warren Atkinson, P.O. Box 515, Pageland, SC (US) 29728

( * ) Notice: Subject to any disclaimer, the term of this patent is extended or adjusted under 35 U.S.C. 154(b) by 0 days.

This patent is subject to a terminal disclaimer.

(21) Appl. No.: 11/466,110

(22) Filed: Aug. 22, 2006

Related U.S. Application Data

(62) Division of application No. 10/867,334, filed on Jun. 14, 2004, now Pat. No. 7,104,620.

(60) Provisional application No. 60/495,790, filed on Aug. 14, 2003.

(51) Int. Cl.
*A47B 67/02* (2006.01)

(52) U.S. Cl. ..... 312/242; 312/204

(58) Field of Classification Search ..... 312/204, 312/242, 245, 246, 321.5, 226, 206, 304, 312/305; 220/529, 536, 545, 551, 552
See application file for complete search history.

(56) References Cited

U.S. PATENT DOCUMENTS 2,039,065 A * 4/1936 De Mark ..... 312/206
2,697,646 A * 12/1954 Craig ..... 312/229
2,790,692 A * 4/1957 Sharpe ..... 312/228
2,955,893 A * 10/1960 Dorval ..... 312/245
2,965,429 A * 12/1960 Stanger ..... 312/242
3,220,791 A * 11/1965 Pokryfke et al. ..... 312/242
4,006,948 A * 2/1977 Kessinger ..... 312/242
4,033,650 A * 7/1977 Alissandratos ..... 312/206
D246,191 S * 10/1977 Russo et al. ..... D24/229
4,304,447 A * 12/1981 Ellwood et al. ..... 312/204
4,585,199 A * 4/1986 Chap ..... 248/682
4,929,039 A * 5/1990 Thomas et al. ..... 312/213
5,893,531 A * 4/1999 Taylor et al. ..... 242/598.6
5,984,100 A * 11/1999 Ramsey et al. ..... 206/581
6,003,964 A * 12/1999 Baker ..... 312/206

* cited by examiner

*Primary Examiner*—James O. Hansen
(74) *Attorney, Agent, or Firm*—F. Rhett Brockington

(57) ABSTRACT

An outdoor storage compartment with a housing having exterior rectangular side walls, an interior semicircular side wall, with an open-side, a center swinging door with an integral tray, and a magnetic closure. The door has a center elongate bearing, to hingedly rotate on an axial pin that is vertically spanning the open-side of the housing. The magnets in the magnetic closure are not in contact. When opened, the integral tray is conveyed from the protective interior of the housing to the exterior of the housing. As the door is opened it sweeps the interior semicircular side wall. The door has one radial length section that is slightly shorter than the second radial length section, where the radial length is the length of door measured from the elongate bearing to an end of the door. The shorter section and the integral tray can sweep through the interior of the housing, while the longer section is restrained.

16 Claims, 8 Drawing Sheets

OUTDOOR STORAGE COMPARTMENT

CROSS REFERENCE TO RELATED APPLICATION

This application is a divisional patent application of patent application, bearing Ser. No. 10/867,334, which was filed on Jun. 14, 2004, now U.S. Pat. No. 7,104,620 and claims the benefit of the earlier filing date of the provisional application, bearing Ser. No. 60/495,790, which was filed on Aug. 14, 2003.

BACKGROUND OF THE INVENTION

1) Field of the Invention

The invention relates generally to a storage compartment, and more particularly to an outdoor storage compartment that is humanly easy to open and close, that provides a relatively protective environment, that can be camouflaged or have an esthetically attractive appearance, and that can be accessed without digging into the compartment, and that has a novel magnetic closure with a smooth opening and closing action.

2) Prior Art

The prior art principally teaches indoor compartments or cabinets, such as Thomas et. al., in U.S. Pat. No. 4,929,039, which is a toothbrush cabinet for holding toothbrushes and toothpaste in bathrooms. The Thomas patent teaches a cabinet that has a bottom opening door and an integral rack. Along the same lines, Judy Baker, in U.S. Pat. No. 6,003,964, teaches a cabinet with a side hinged door, where the cabinet is designed to be an insert in a wall. John Chap, in U.S. Pat. No. 4,585,199, teaches a retractable soap dish that can be flipped out forming therein providing a soap tray.

What is needed is a compartment or cabinet that can withstand the rigors of outdoors, that provides for the occasion where some undesired element, such as a spider or bee, might be within, and that has a relatively few number of parts so that it can easily manufactured and maintained. Preferably, the cabinet can be camouflaged and/or have an esthetically attractive appearance, and provide some flexibility in the level of security.

SUMMARY OF THE INVENTION

The invention is an outdoor storage compartment comprised of: a housing having an interior with an open-side, a center swinging door with an integral tray, and a magnetic closure. The door can nominally be opened by pressing a designated push point near an end of the door, therein causing the door, which has a center elongate bearing, to hingedly rotate on an axial pin that vertically spans the open-side of the housing. The door can easily be opened with the pressure of only one finger. When opened, the integral tray is conveyed from the protective interior of the housing to an easily visible position on the exterior of the housing. As the door is fully opened it sweeps through a rotational arc of about 180 degrees, so that an interior face of the door pivots to the exterior of the housing. The door is sized so that one radial length section is slightly shorter than a second radial length section, where the radial length is the length of door measured from the elongate bearing to an end of the door. The shorter section of the door and the integral tray can sweep through the interior of the housing, while the longer section of the door is restrained. The interior of the housing preferably has substantially semicircular side walls, having a curvature that is just slightly less than the curvature of rotational arc of the door. Alternatively stated, said center swinging door has a shorter section and a longer section, where the shorter section has a length that has a radial length that is just slightly less than a radius of the semicircular side wall, and whereas the longer section has a length that will contact the semicircular side wall. The housing has an interior height, as measured from a bottom wall of the housing to a top wall, which is preferably just slightly greater than a height of the door. The net desired effect is that as the door is opened and closed, the door nearly swipes the interior walls of the housing, thereby maintaining the interior of the housing clean and door freely moving. The instant invention is primarily intended for use as an outdoor fixture, and it is recognized that over time, insects and detritus will accumulate on the interior of the outdoor storage compartment. The repeated action of the door purges the insects, detritus, and items that may have fallen out of the tray, effectively making the outdoor storage compartment self-cleaning. The housing has an opening stop and a closing stop, where the opening stop defines the exact position where the door is fully open, and the closing stop defines the exact position where the door is fully closed. The stops also prevent the longer section of the door from becoming jammed, as the stops eliminate the possibility that the longer section of the door can become wedged in the interior of the housing. The magnetic closure is comprised of at least one magnet, and preferably at least two. Generally better closure performance is achieved with at least two magnets, where a pole on a first magnet is positioned to be aligned in attraction to a pole on a second magnet. It is recognized that a magnet is attracted not only to another magnet but also to certain materials, most commonly iron, that exhibit the property of ferro-magnetism. In the preferable magnetic closure, the attracted magnets or the magnet and the ferro-magnetic material, at their nearest position, are never in direct contact. By eliminating direct contact, the resulting magnetic closure has a smooth release and closure that is free of the jerky action that is typical of prior art magnetic closures. The smooth release and closure is especially important in the instant invention, because it assures that items in the tray are not thrown out of the tray when the center swinging door is opened or closed. In one embodiment a first magnet is seated recessed on the bottom of the integral tray, substantially flush with bottom and proximal to an end of the door, and a second magnet is seated recessed on the bottom of the housing, so that when the door is closed the first and second magnet are aligned in attraction. The first and second magnets are separated by a small distance, but are never in direct contact. The operation of the door is smooth and gradual. The force of magnetic attraction can be quantified as easily overcome with finger pressure, yet sufficient to prevent the door from opening accidentally or own its own if the outdoor storage compartment is not mounted substantially level. The outdoor storage compartment can be mounted substantially as a stand alone unit or integral to a wall. The housing can be fitted with fastening devices or adhesive elements for attachment to an outdoor structure such as a deck, a fence, a wall or a pole. Alternatively, the outdoor storage compartment can be formed as an integral part of a wall, where the front of the storage compartment is substantially flush with the integral wall. In one embodiment, the external dimensions are selected to match a brick. When the wall is built the outdoor storage compartment is inserted in the wall in place of a brick. The bottom of the housing is dimpled/indented and/or has knockouts to form a more secure bond to the cementing mortar and/or is a means for mounting fastening elements. The exterior of the housing can have an external surface that is textured and colored to match the mortar or other characteristic of the wall. The open-side of the housing can have a perimeter flange, which retains the cementing mortar and facilitates making a clean edge around the open-side of the storage compartment. The outdoor storage compartment can be camouflaged for esthetic or security reasons to match the wall with a fascia plate. An exterior face of the door can have a perimeter frame that matches the mortar and the fascia plate, such as a brick or stone plate adhered to the exterior face of the door. The thickness of the fascia brick or stone is selected so that the fascia brick or stone protrudes to approximately the same position as the adjacent bricks or stones. To add another layer of security, the door of the outdoor storage compartment can have a lock, so that a key or combination must be used to open the compartment.

Applications for the outdoor storage compartment include, but are not limited to, storing soap, keys, tools, weapons, matches, written instructions, snacks, cell phones, money, medicines, lotions, insect repellants, and personal items such as glasses. The tray preferably has a scalloped bottom with ridges and drain holes for storing bar soap.

The rugged qualities of the instant invention lend itself to being useful in indoor applications where the environment can be harsh, for instance in a laboratory, bathroom or kitchen, especially where soap and water are used. It is anticipated that the outdoor storage compartment can be anodized, coated (i.e., painted), and/or plated (i.e., gold plated, chrome plated); making it particularly functionally and esthetically suitable as an indoor fixture.

DETAILED DESCRIPTION OF THE INVENTION

Figure 1:
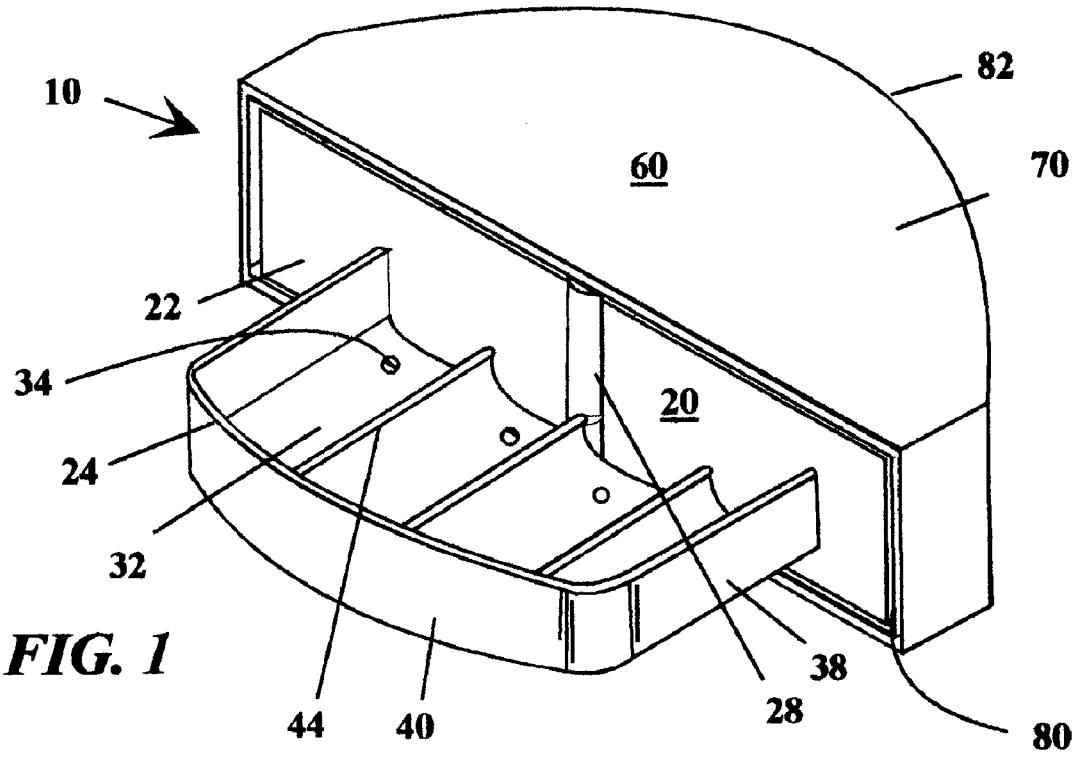
FIG. 1 is a perspective view of the invention, an outdoor storage compartment, wherein the center swinging door with integral tray is open.

The invention is an outdoor storage compartment 10 comprised of: a housing 60 having an interior with an open-side, a center swinging door 20 with an integral tray 24, and a magnetic closure 90 (not shown, see FIGS. 3*a*-*e*). In a preferred embodiment, the housing and the center swinging door with integral tray are cast as solid single components. A preferred material is aluminum for its combination of strength and weather resistance. Referring to FIG. 1, the outdoor storage compartment 10 is shown with the center swinging door 20 open. The housing 60 has semicircular side walls 82 and an open-side 80. The tray 24 is integral to the interior side 22 of the door 20. In the illustrated embodiment, the tray 24 has a bottom that is scalloped 32, with interval ridges 44 and drain holes 34. The tray is especially suitable for storing bar soap. The tray 24 has four walls, a front wall 40, two side walls 38 and the interior side 22 of the door 20. In approximately the center of the door there is an elongate bearing 28, which is also integral to the center swinging door 20. The door hingedly pivots on an axial pin 30, as shown in FIGS. 3*a*-*e* and FIG. 11.

Figure 2:
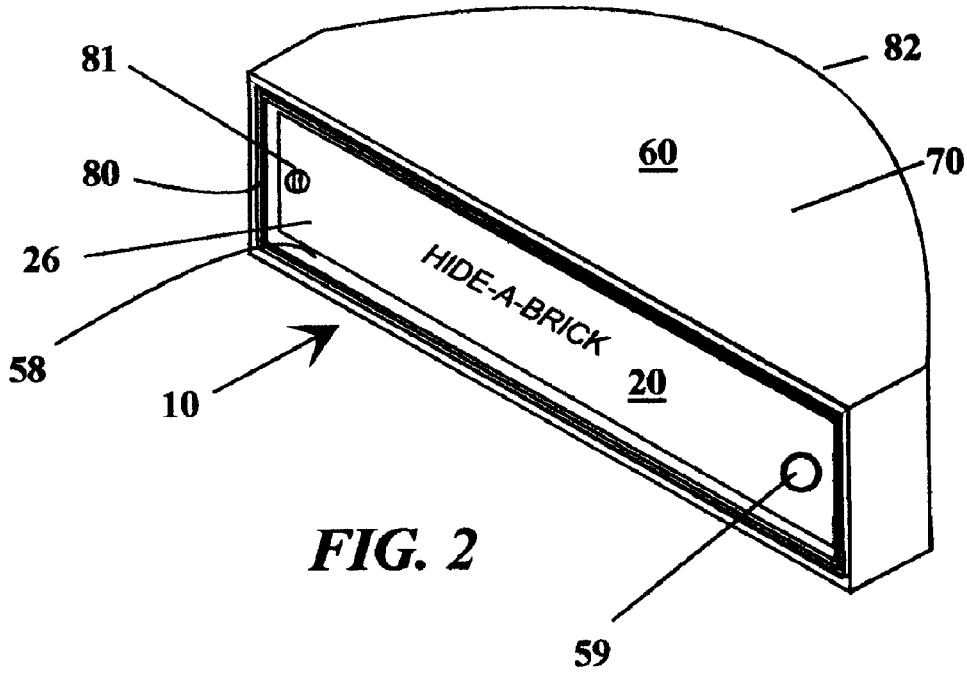
FIG. 2 is a perspective view of an embodiment of the outdoor storage compartment, wherein the center swinging door with integral tray is closed and the housing has exterior semicircular side walls.

Referring to FIG. 2, which is a perspective view of the outdoor storage compartment 10 shown in FIG. 1, wherein the center swinging door 20 is closed. The exterior side 26 of the door 20 is marked with a push point 59 for applying pressure to open the door, and a lock 81 for securing the storage compartment. The edges of the exterior side 26 has a perimeter frame 58, which is substantially flush with the edges of the open-side 80 of the housing 60. As will be discussed later, the perimeter frame 58 can be used to align and support a fascia plate, such as a fascia brick.

Figure 3A:
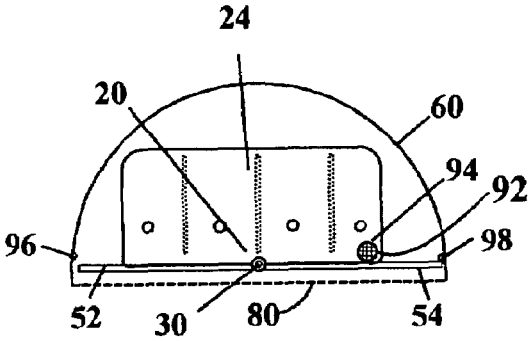
FIGS. 3*a*-3*e* is a series of schematic illustrations of the outdoor storage compartment, wherein the door with integral tray is moved from the closed position to the fully opened position.
Figure 3B:
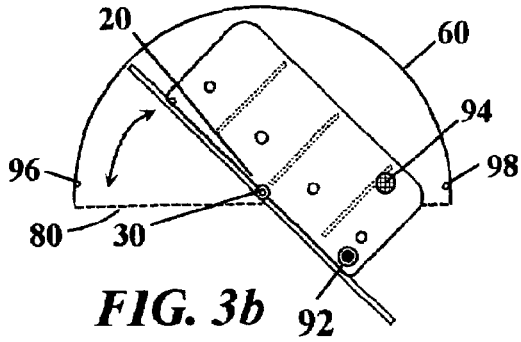
Figure 3C:
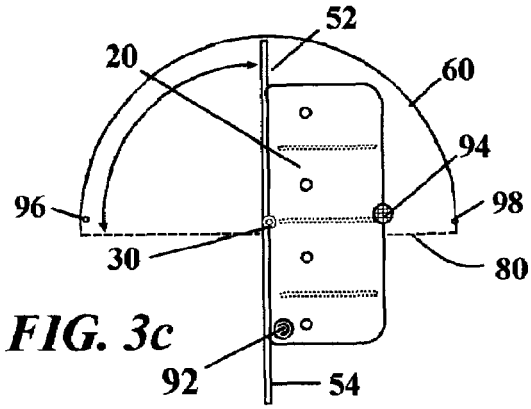
Figure 3D:
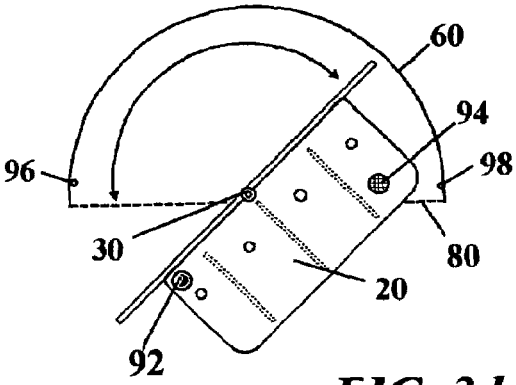
Figure 3E:
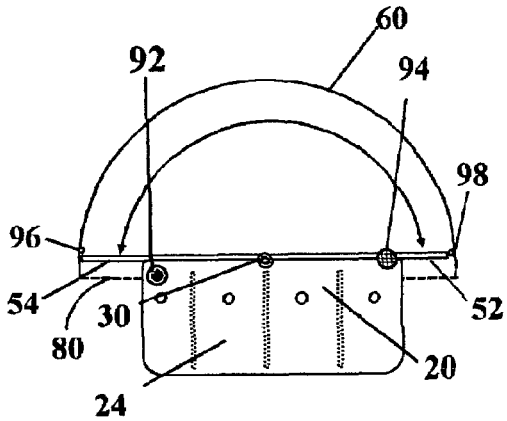
Figure 4:
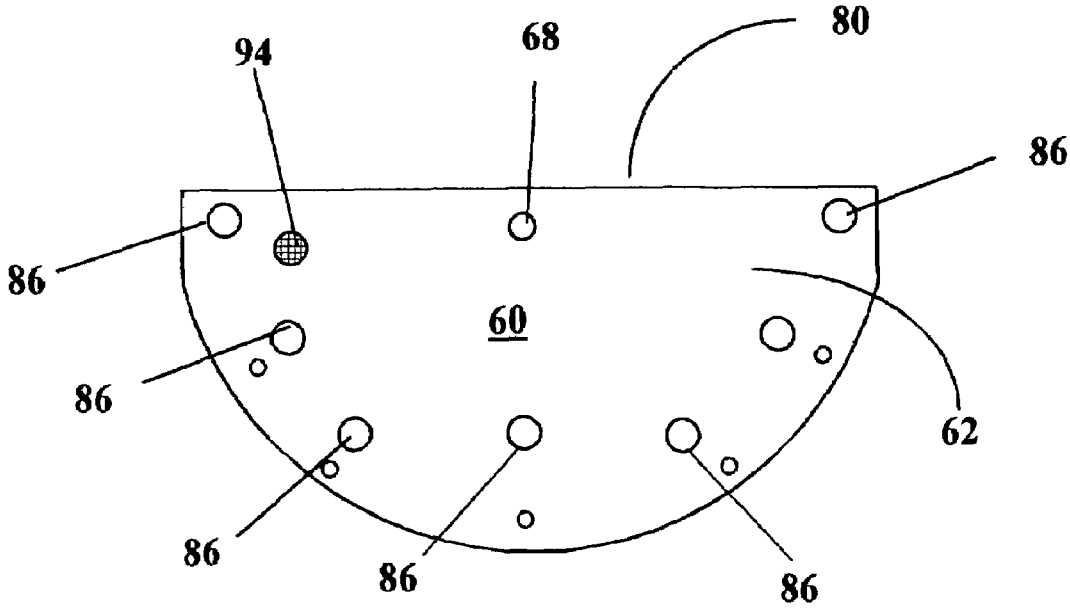
FIG. 4 is a plan view of the bottom of the outdoor storage compartment, which illustrates stabilizing indentures/knockouts for potentially improving the shear resistance and adhesion to mortar, and a means for mounting fastening elements. Also illustrated is a second magnet, seated recessed and adhered to the bottom.

Referring to FIG. 4, the bottom 62 of the housing 60 has multiple recessed areas, which are stabilizing indentures/knockouts 86, which improve the bond and shear of mortar to the outdoor storage compartment 10, or alternatively when used with fastening elements are attachment points for brackets, screws, brads and the like. The bottom 62 has a lower bushing 68 for receiving the axial pin. The bottom 62 also has a second magnet 94, positioned near the open-side 80 of the housing 60, and comprises one of the two magnets of a magnetic closure. The first magnet 92 (see FIGS. 3*a*-*e*) and the second magnet 94, when aligned, are separated by a small distance, which, in the illustrated embodiment, is approaching the thickness of the housing 60. The first and second magnets, 92 and 94, are never in direct contact with each other. The operation of opening and closing the centering swinging door 20 is smooth and gradual. The force of magnetic attraction can be quantified as easily overcome with finger pressure, yet sufficient to prevent the door from opening accidentally on own its own if the outdoor storage compartment 10 is not mounted substantially level.

Figure 5:
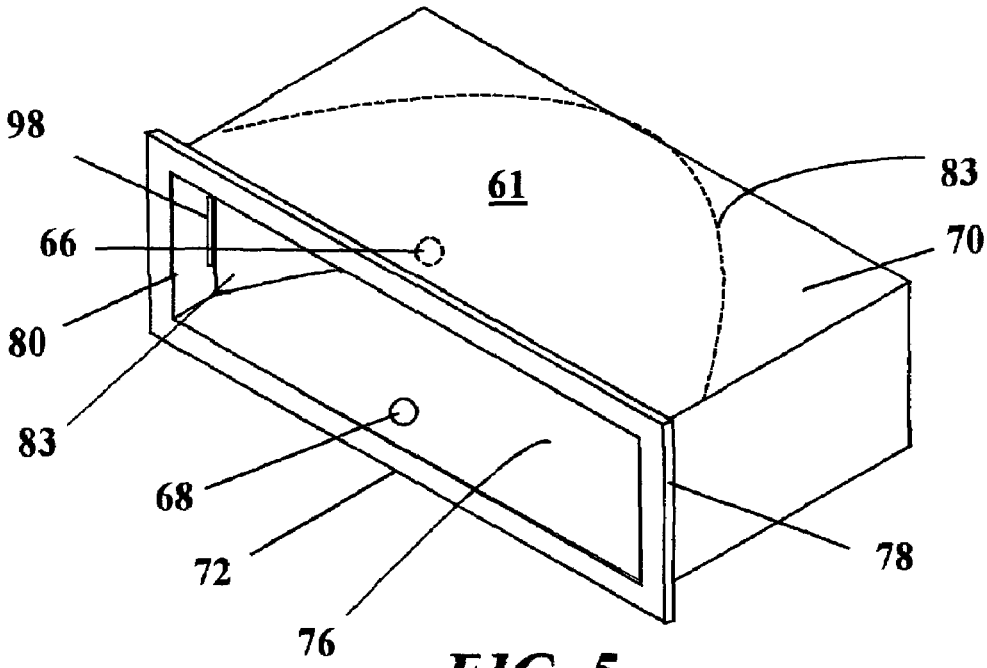
FIG. 5 is a perspective view of an alternate embodiment of the housing of the outdoor storage compartment, wherein the housing is rectangular and the open-side has a flange. The semicircular side walls are in the interior, and partially shown in ghost.

A perspective view of a rectangular housing 61 is shown in FIG. 5. Like the housing 60 with semicircular side walls 82, the rectangular housing 61 also has semicircular side walls, but they are interior semicircular side walls 83. The walls 83 are partially shown from the top as a dashed line. From this view the lower bushing 68 is visible, and the upper bushing 66 is indicated by dashed lines. In the interior 76 of the housing, near the open-side 80, the housing has a closing stop 98 and an opening stop 96 (see FIG. 3 to see both). The closing stop 98 prevents the door 20 from rotating into the housing. The illustrated rectangular housing 61 has a perimeter flange 72, which retains the cementing mortar and facilitates making a clean edge around the open-side of the storage compartment 10. The perimeter flange 72 can be used with any shaped housing.

Referring to FIGS. 3*a*-3*e*, which is a series of schematic illustrations of the outdoor storage compartment, as seen from the bottom, that shows how the door 20 with integral tray moves from the closed position to the fully opened position. This movement conveys the tray to the exterior and sweeps the interior 76 side of the semicircular side walls 82, the top 70 and the bottom 62. In FIG. 3*a* the center swinging door 20 is fully closed. The elongate bearing pivots on axial pin 30. The longer section 54 of the door is resting against the closing stop 98, and the shorter section 52 is free to clear the opening stop 96. When finger is applied against the shorter section 52, the shorter section of door rotates inward and the longer section rotates outward. The relative position of the first magnet 92, which is embedded on the bottom side of the tray, with respect to the second magnet, which is embedded on the bottom side of the housing bottom 62, is shown in FIGS. 3*a*-*e*. When closed the first and second magnets are superimposed with their poles in attractive alignment forming the magnetic closure. As the door rotates, the first magnet 92 is moved away from the second magnet 94, which is stationary in the housing. FIG. 3*e* illustrates that the longer section 54 is free to rotate about 180 degrees until in comes into contact with the opening stop 96. The tray 24 is now on the exterior of the housing 60. In use, when the magnets are close to alignment, but never in direct contact, as shown in FIG. 3*a* the force of attraction is sufficient to overcome the weight of the center swinging door 20 with integral tray. Movement of the door with integral tray causes the magnetic attractive force of the magnetic closure to decreases rapidly, but not to a point where movement is jerky.

Figure 11:
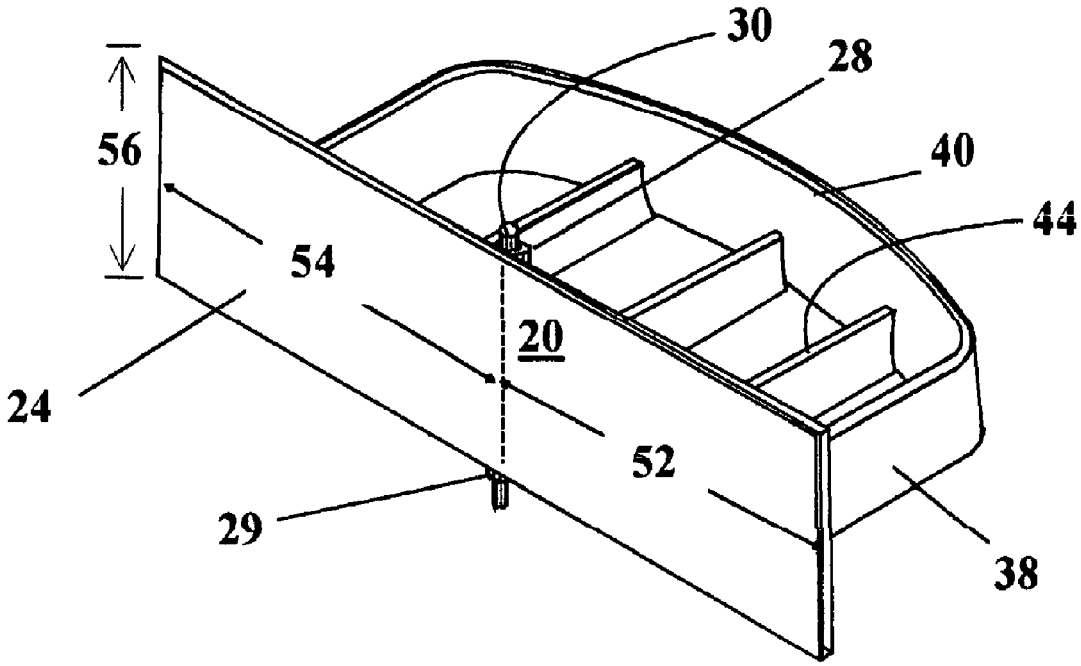
FIG. 11 is a perspective view of the center swinging door with the integral tray. The view further includes an axial pin projecting through the elongate bearing.

FIG. 11 is a perspective view of the center swinging door 20 with the integral tray. The door can be broken down into two sections, a longer section 54 and a shorter section 52. In the drawing the differences have been exaggerated to clarify the functional mechanism. The shorter section rotates through the interior of the housing 60 or 61, and the longer section is stopped by the opening stop 96 and the closing stop 98. In one embodiment the length of the longer section 54 is 9.8 cm, and the length of the shorter section 52 is 9.5 cm, so that substantially there is no perceptible difference in length. But the difference is enough so that the shorter section is not resisted by either of the stops, 96 or 98. The door has a height 56 that is just less than the height of the housing. The door has an integral elongate bearing 28 that is cast when the door is formed. The bearing 28 has an annular chamber through which passes the axial pin 30. The length of the elongate bearing 28 is slightly longer than the height 56 of the door, therein offsetting the door 20 from the bottom 62 (see FIG. 4) of the housing 60. Nominally, the axial pin is positioned when the elongate bearing 28 is lined up with the upper bushing 66 and the lower bushing 68 of the housing 60.

Figure 6:
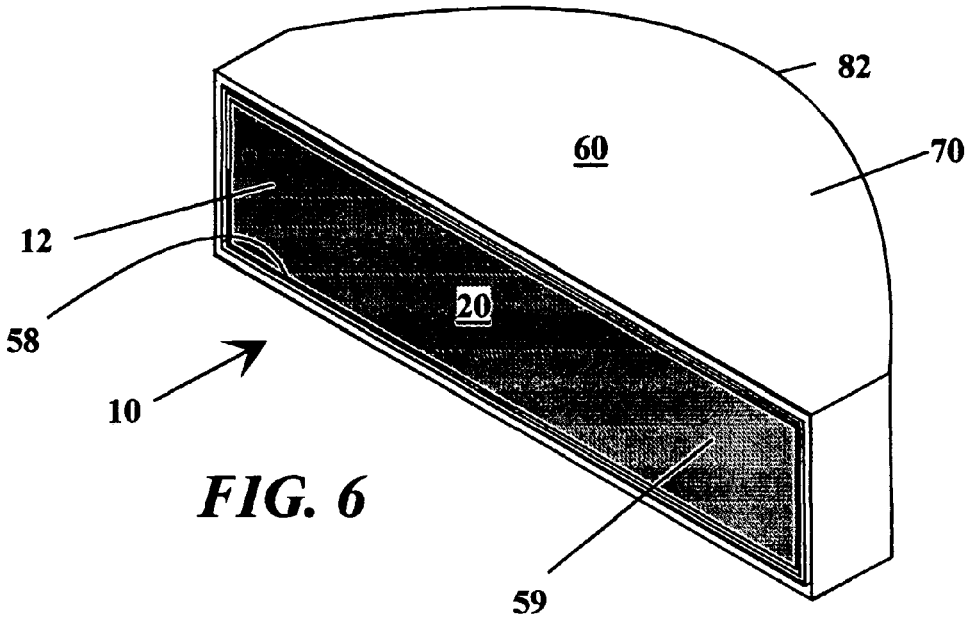
FIG. 6 is a perspective view of an embodiment of the outdoor storage compartment, wherein the exterior side of the center swinging door has a brick fascia.

Referring to FIG. 6, which is a perspective view of the outdoor storage compartment 10, wherein the exterior side 26 of the center swinging door 20 has a brick fascia 12. The brick fascia 12 is mounted to the exterior side 26 of the door with adhesive. The perimeter frame 58 indicates the approximate desired thickness of the brick fascia 12, and helps in centering the fascia on the door 20.

Figure 8:
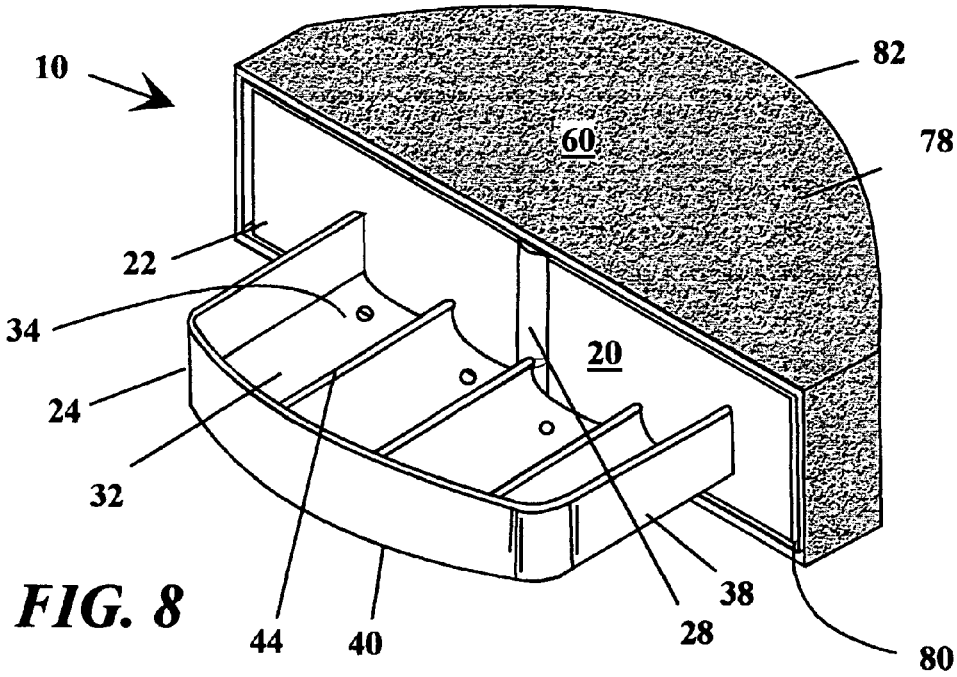
FIG. 8 is a perspective view of an embodiment of the outdoor storage compartment, wherein the exterior of the housing has a texture and color similar to brick mortar.

The outdoor storage compartment 10 can be mounted as a stand alone unit, or integral to a wall. The wall can be comprised of discreet components, such as a brick wall, a concrete block wall, a stone wall or a combination thereof, or comprised of sectional components such as a wood, aluminum, vinyl siding wall, or a combination sectional components and discreet components, such as a stucco wall. In the illustrated embodiment, a brick wall is representatively shown. The exterior of the housing 60, in addition to having indentions 86 as shown in FIG. 4, can also have a textured surface 78, which mimics cement mortar or another appropriate feature of the integral wall (i.e., stucco, siding, stone). FIG. 8 illustrates the housing 60 of a outdoor storage compartment 10, wherein the exterior 78 is roughened and colored to match the appearance of mortar containing sand.

The outdoor storage compartment 10 can be mounted integral to the brick wall 100 either with, or without the fascia plate, in this case a brick fascia 12. The housing can be rectangular as shown in FIG. 5, semicircular as shown in FIG. 2, and with or without a flange 72, as illustrated in FIG. 5.

Figure 7A:
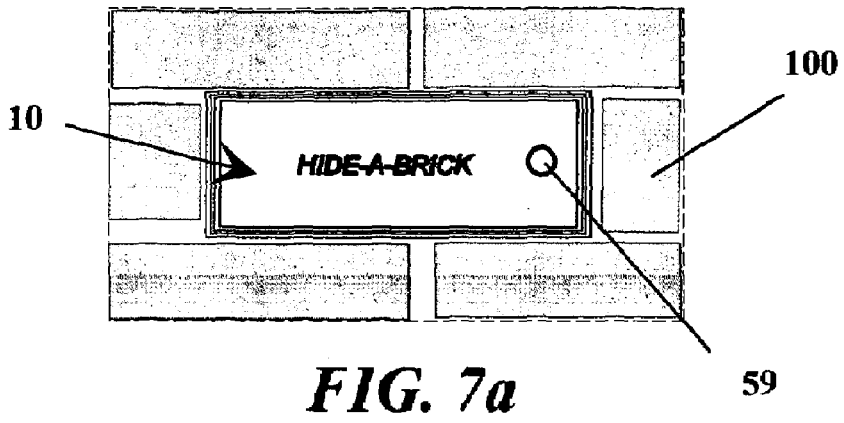
FIGS. 7*a*-*c* is a series of illustrations showing the invention integral to a brick wall with the door closed and partially open.
Figure 7B:
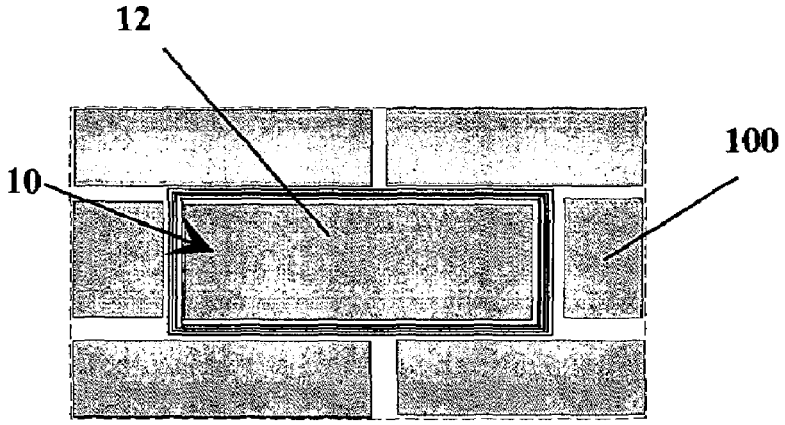
Figure 7C:
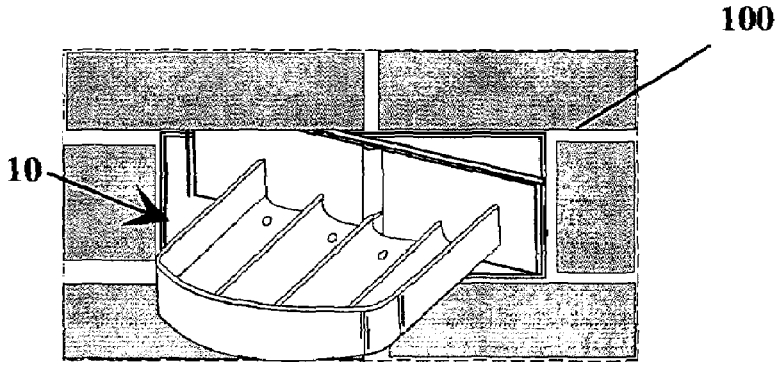

FIGS. 7*a*-*c* is a series of frontal views showing the invention without a brick fascia, as in FIG. 2, and with a brick fascia, as in FIG. 6, wherein the compartment 10 is integral to the brick wall 100. Note, in FIG. 7*c*, the door is substantially open, and the invention appears the same once opened.

Figure 9:
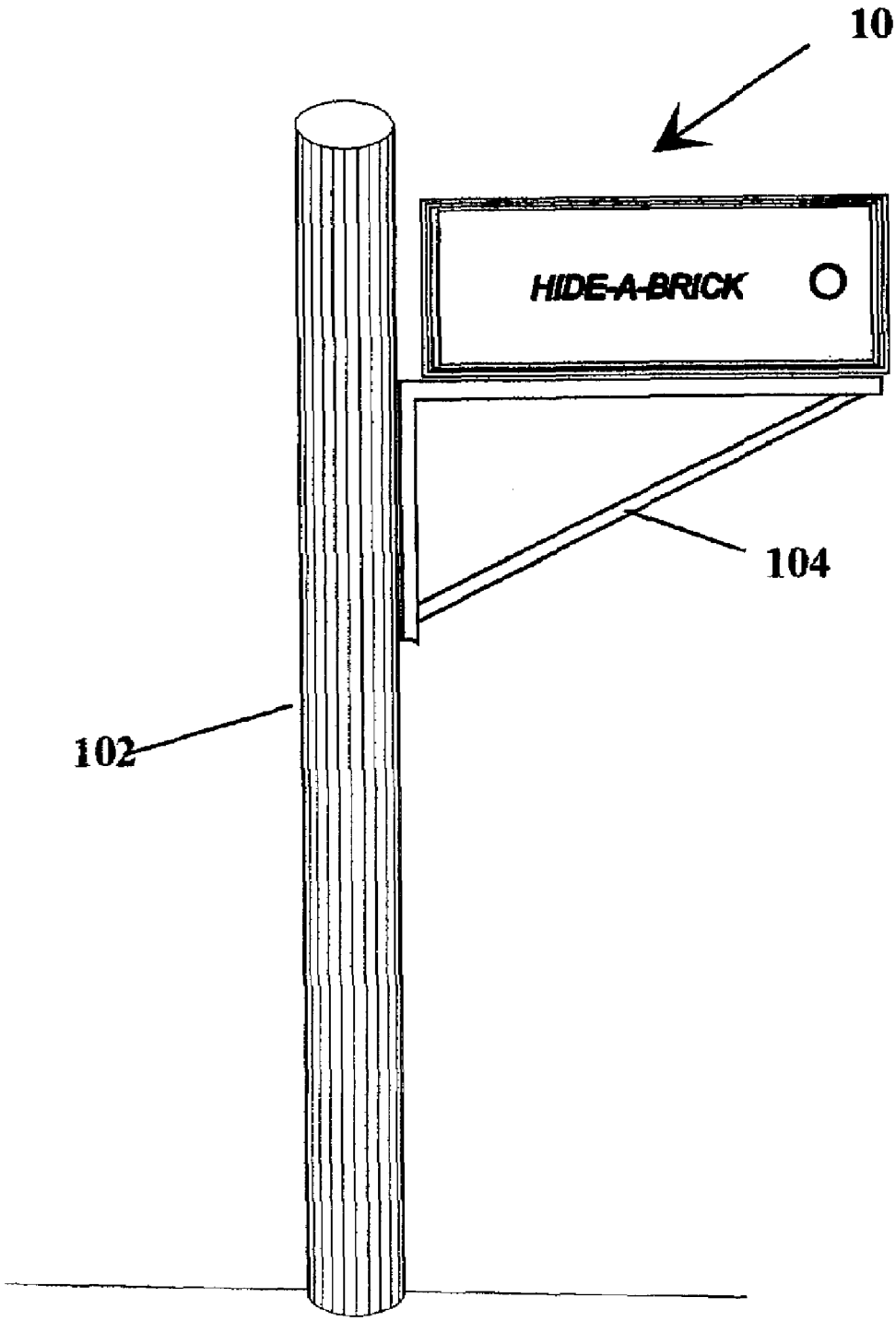
FIG. 9 is a frontal view of the invention mounted standalone to a post.
Figure 10:
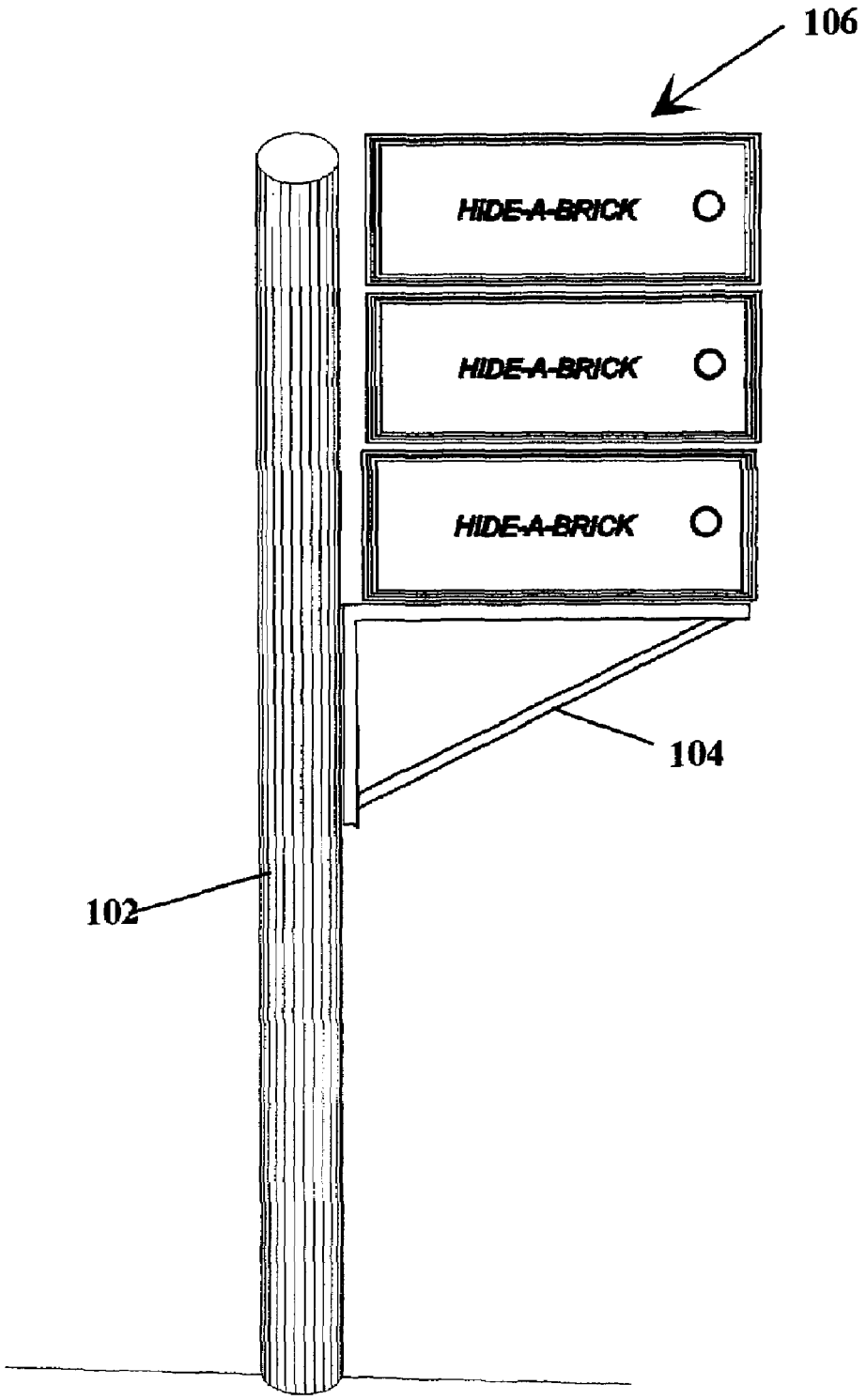
FIG. 10 is a frontal view of an array of outdoor storage compartments mounted to a post.

The outdoor storage compartment 10 can be fitted with mechanical or adhesive fastening elements for attachment to an outdoor structure such as a deck, a fence, a wall or a pole. FIG. 9 is a frontal view of the invention 10 mounted stand-alone to a post 102 using an L shaped bracket 104 having a supporting strut. Multiple outdoor storage compartments 10 can be combined, in essence forming an array 106, or chest of compartments. FIG. 10 is a frontal view of an array of outdoor storage compartments mounted on post 102 with an L shaped bracket 104 having a supporting strut.

As various possible embodiments might be made of the above invention, and as various changes might be made in the embodiments above set forth, it is understood that all matters herein described or shown in the accompanying drawings are to be interpreted as illustrative and not limiting. It is fully anticipated that the invention can be used as an indoor fixture.

What is claimed is:

1. An outdoor storage compartment comprising:

a housing having exterior rectangular side walls, an interior semicircular side wall, a top wall, a bottom wall, and an open-side, therein forming an accessible interior;

a center swinging door with an integral tray;

a magnetic closure;

wherein said center swinging door hingedly rotates on an integral elongate bearing and an axial pin that spans the open-side of the housing;

wherein said center swinging door has a shorter section and a longer section, as measured from the elongate bearing to an end of the door, where the shorter section has a length that has a radial length that is just slightly less than a radius of the interior semicircular side wall, and whereas the longer section has a length that will contact the interior semicircular side wall or a stop; and wherein said housing has a closing stop and an opening stop, where the closing stop prevents an interior side of the longer section of the door from rotating into the interior of the housing, and the opening stop prevents an exterior side of the longer section of the door from rotating into the interior of the housing.

2. The outdoor storage compartment, as claimed in claim 1, wherein said magnetic closure is comprised of a first magnet mounted in the center swinging door with integral tray and a second magnet mounted in the bottom of the housing, wherein the magnets are not in direct contact, and, are substantially in polarity attractive alignment when the door is closed.

3. The outdoor storage compartment, as claimed in claim 2, wherein the first and second magnets are located proximal to the end of the door, when the door is closed.

4. The outdoor storage compartment, as claimed in claim 3, wherein a second pair of first and second magnets are located proximal to an opposing end of the door.

5. The outdoor storage compartment, as claimed in claim 1, wherein said door with integral tray has a perimeter frame on the exterior side of the door.

6. The outdoor storage compartment as claimed in claim 1, wherein the exterior side of the door has a fascia plate.

7. The outdoor storage compartment, as claimed in claim 1, wherein said outdoor storage compartment has a lock.

8. The outdoor storage compartment as claimed in claim 1, wherein said bottom wall of the housing has indentions or knockouts to improve adhesion to mortar and otherwise to be employed for attachment of fastening devices.

9. The outdoor storage compartment as claimed in claim 1, wherein said open-side has a flange.

10. The outdoor storage compartment, as claimed in claim 1, wherein said integral tray has a front wall, side walls, a scalloped bottom with interval ridges, and drain holes.

11. The outdoor storage compartment, as claimed in claim 1, wherein the exterior of said housing has a textured colored surface that simulates cement mortar.

12. The outdoor storage compartment as claimed in claim 1, wherein said outdoor storage compartment is composed principally of aluminum.

13. The outdoor storage compartment as claimed in claim 1, wherein said center swinging door with integral tray and integral elongate bearing is cast as a single piece.

14. The outdoor storage compartment as claimed in claim 1, wherein said housing is cast as a single piece.

15. The outdoor storage compartment as claimed in claim 1, wherein said outdoor storage compartment is mounted integral to a wall.

16. The outdoor storage compartment as claimed in claim 1, wherein said outdoor storage compartment is further comprised of fastening devices or adhesive elements for attachment to an outdoor structure.

* * * * *